US009010415B2

(12) United States Patent
Benzie et al.

(10) Patent No.: US 9,010,415 B2
(45) Date of Patent: Apr. 21, 2015

(54) APPARATUS AND METHOD FOR EXPANDING TUBULARS IN A WELLBORE

(75) Inventors: Scott A. Benzie, Houston, TX (US); Alessandro O. Caccialupi, Houston, TX (US); Andrei G. Filippov, Houston, TX (US)

(73) Assignee: Mohawk Energy Ltd., Houston, TX (US)

( * ) Notice: Subject to any disclaimer, the term of this patent is extended or adjusted under 35 U.S.C. 154(b) by 731 days.

(21) Appl. No.: 13/308,201

(22) Filed: Nov. 30, 2011

(65) Prior Publication Data

US 2013/0133901 A1 May 30, 2013

(51) Int. Cl.
*E21B 43/10* (2006.01)
*E21B 23/01* (2006.01)

(52) U.S. Cl.
CPC ..... *E21B 43/103* (2013.01)

(58) Field of Classification Search
USPC ..... 166/206, 207, 382
See application file for complete search history.

(56) References Cited

U.S. PATENT DOCUMENTS 3,669,190 A * 6/1972 Sizer et al. ..... 166/387
7,383,889 B2 * 6/2008 Ring et al. ..... 166/382
7,493,946 B2 * 2/2009 Filippov et al. ..... 166/216
7,775,290 B2 * 8/2010 Brisco et al. ..... 166/384
2007/0240878 A1 10/2007 Filippov et al.
2009/0229835 A1 9/2009 Filippov

FOREIGN PATENT DOCUMENTS

EP 2202383 A1 6/2010

OTHER PUBLICATIONS

GB Application No. 1206873.0 Search Report dated Aug. 16, 2012.

* cited by examiner

*Primary Examiner* — David Bagnell
*Assistant Examiner* — Richard Alker
(74) *Attorney, Agent, or Firm* — Tumey L.L.P.

(57) ABSTRACT

Disclosed is an expansion assembly and method to expand tubulars. In embodiments, an expansion assembly for disposition in a wellbore includes an expandable tubular and an expansion tool that has a swage and a thruster. In addition, the expansion tool has a front anchor assembly that has a front anchor having an open position providing an anchoring relationship with the internal wall and a closed position providing the front anchor with a diameter less than an internal diameter of the expandable tubular. The front anchor assembly also has a sensor positioned on an opposing side of the front anchor from the expansion swage providing that while the sensor is positioned inside the internal wall the front anchor may be in an open position or in a closed position while upon exit of the sensor from the end portion the sensor brings the front anchor in a permanently closed position.

20 Claims, 2 Drawing Sheets

APPARATUS AND METHOD FOR EXPANDING TUBULARS IN A WELLBORE

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

This invention relates to the field of radially expanding tubulars and more specifically to radially expanding tubulars with an expansion assembly having a front anchor assembly.

2. Background of the Invention

Recently, methods and apparatus have been developed for placing tubular strings in a wellbore and then expanding the internal and external diameters of the strings in order to increase a fluid or gas path through the tubular or to line the walls of a wellbore. There are many conventional methods of downhole expansion of tubulars.

Conventional methods include an expansion apparatus that typically includes expander tools, which may be fluid powered and may be run into the wellbore on a work string. The hydraulic expander tools may include an expansion swage, a thruster including multiple pistons capable of providing a sufficient force to propel the expansion swage inside the expandable tubular, and a front and rear anchor. As sufficient pressure is generated, the front anchor may be engaged with the internal wall of the tubular and provide sufficient reaction force for swage propagation inside the tubular. The pressure may then be released, and the anchor may be disengaged from the tubular. The tool may be reset by moving the front anchor forward. This operation is typically repeated multiple times until the front anchor exits the tubular. The rear anchor may then be engaged to provide sufficient reaction force for swage propagation to finish the expansion of the end part of the tubular. However, drawbacks have been encountered with the conventional expansion apparatus. For instance, drawbacks include when the front anchor exits the end portion of the expandable tubular. As pressure is applied, the front anchor being out of the tubular opens-up to the diameter larger than the tubular internal diameter, and the thruster may pull it back inside the tubular against the expansion face of the swage. This may result in damage of the tubular, which may result in failure of the tubular during expansion with the rear anchor and/or damage of the front anchor. Retrieval of the tool may then be problematic.

Consequently, there is a need for an improved method and apparatus for radially expanding tubulars in a wellbore.

BRIEF SUMMARY OF SOME OF THE PREFERRED EMBODIMENTS

These and other needs in the art are addressed in one embodiment by an expansion assembly for disposition in a wellbore. The expansion assembly includes an expandable tubular having an internal wall and an end portion. The internal wall has an internal diameter. The expansion assembly also has an expansion tool. The expansion tool has an expansion swage and a thruster. The expansion swage defines a front direction towards a smaller diameter of the expansion swage. The expansion tool also has a front anchor assembly positioned in front of the expansion swage. The front anchor assembly has a front anchor having an open position providing an anchoring relationship with the internal wall and a closed position providing the front anchor with a diameter less than an internal diameter of the expandable tubular. The front anchor assembly also has a sensor positioned on an opposing side of the front anchor from the expansion swage providing that while the sensor is positioned inside the internal wall the front anchor may be in an open position or in a closed position while upon exit of the sensor from the end portion the sensor brings the front anchor in a permanently closed position.

These and other needs in the art are addressed in another embodiment by an expansion tool for disposition in a wellbore. The expansion tool has an expansion swage and a thruster. The expansion swage defines a front direction towards a smaller diameter of the expansion swage. The expansion tool also has a front anchor assembly positioned in front of the expansion swage. The front anchor assembly has a front anchor having an open position providing an anchoring relationship with the internal wall of expandable tubular and a closed position providing the front anchor with a diameter less than an internal diameter of the expandable tubular. The front anchor assembly also has a sensor positioned on an opposing side of the front anchor from the expansion swage providing that while the sensor is positioned inside the internal wall the front anchor may be in an open position or in a closed position while upon exit of the sensor from the end portion the sensor brings the front anchor in a permanently closed position.

In addition, these and other needs in the art are addressed in an embodiment by a method of expanding a tubular in a wellbore. The method includes running an expansion assembly in the wellbore. The expansion assembly includes an expandable tubular having an internal wall and an end portion. The internal wall has an internal diameter. The expansion assembly also has an expansion tool. The expansion tool has an expansion swage and a thruster. The expansion swage defines a front direction towards a smaller diameter of the expansion swage. The expansion tool also has a front anchor assembly positioned in front of the expansion swage. The front anchor assembly has a front anchor having an open position providing an anchoring relationship with the internal wall and a closed position providing the front anchor with a diameter less than an internal diameter of the expandable tubular. The front anchor assembly also has a sensor positioned on an opposing side of the front anchor from the expansion swage providing that while the sensor is positioned inside the internal wall the front anchor may be in an open position or in a closed position while upon exit of the sensor from the end portion the sensor brings the front anchor in a permanently closed position. In addition, the expansion tool has a rear anchor. The method further includes setting a maximum allowed expansion pressure level. In addition, the method includes applying pressure for expansion swage propagation and observing an expansion pressure plateau level. The method also includes releasing pressure and resetting the expansion tool. Moreover, the method includes repeating the setting the maximum expansion pressure level step and the applying pressure step until observing when a pressure plateau level is lower than the expansion pressure plateau level. The method also includes resetting the maximum expansion pressure level to a level to activate the rear anchor and applying pressure activating the rear anchor. Additionally, the method includes releasing pressure and resetting the expansion tool. The method also includes applying pressure and expanding the end portion. In addition, the method includes releasing pressure and retrieving the expansion tool out of the well.

The foregoing has outlined rather broadly the features and technical advantages of the present invention in order that the detailed description of the invention that follows may be better understood. Additional features and advantages of the invention will be described hereinafter that form the subject of the claims of the invention. It should be appreciated by those skilled in the art that the conception and the specific embodiments disclosed may be readily utilized as a basis for modifying or designing other embodiments for carrying out the same purposes of the present invention. It should also be realized by those skilled in the art that such equivalent embodiments do not depart from the spirit and scope of the invention as set forth in the appended claims.

BRIEF DESCRIPTION OF THE DRAWINGS

For a detailed description of the preferred embodiments of the invention, reference will now be made to the accompanying drawings in which.

DETAILED DESCRIPTION OF THE PREFERRED EMBODIMENTS

Figure 1:
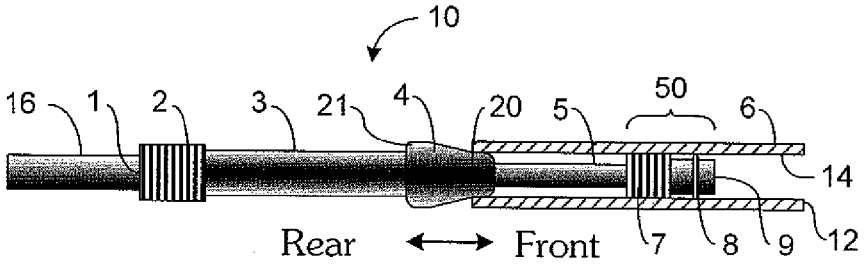
FIG. 1 illustrates a side view of an embodiment of the expansion assembly in the run in position.
Figure 2:
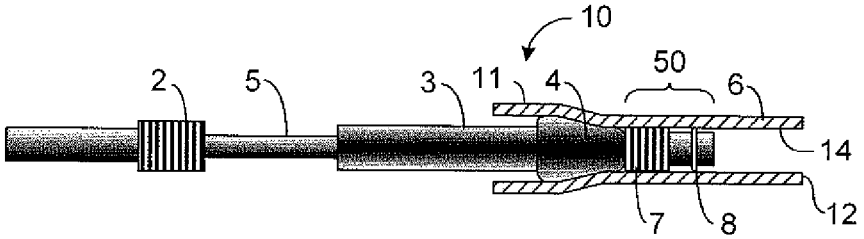
FIG. 2 illustrates a side view of an embodiment of the expansion assembly at the end of the expansion stroke position.

In an embodiment as shown in FIGS. 1-7, expansion assembly 10 includes expansion tool and expandable tubular 6. In embodiments, expansion tool has expansion swage 4, thruster 3, sliding shaft 5, rear anchor 2, and front anchor assembly 50. In an embodiment, front anchor assembly 50 has front anchor 7 and sensor 8. In embodiments as shown, expandable tubular 6 has internal wall 14 and end portion 12. In an embodiment, front anchor assembly 50 is positioned in front of expansion swage 4. In embodiments, front anchor 7 has an open position providing an anchoring relationship with internal wall 14 of expandable tubular 6 and a closed position providing front anchor 7 with a diameter less than the internal diameter of expandable tubular 6. In an embodiment, sensor 8 is positioned in front of front anchor 7, providing that while sensor 8 is positioned inside internal wall 14 of expandable tubular 6 the front anchor 7 may be in open or closed positions. Upon exit of sensor 8 from end portion 12 of expandable tubular 6, sensor 8 brings front anchor 7 in the closed position permanently. Without limitation, expansion tool protects expandable tubular 6 and front anchor 7 at the end part of the expansion process by incorporation of sensor 8, which permanently closes front anchor 7 upon its exit from expandable tubular 6. Permanently closed refers to front anchor 7 being in the closed position regardless of pressure application. Further, without limitation, damage to expandable tubular 6 may therefore be prevented. Damage to front anchor 7 may also be prevented. Expandable tubular 6 may therefore significantly improve the reliability of tubular expansion in the wellbore.

Expandable tubular 6 may be any tubular that may be disposed in a wellbore and that may be expanded. Without limitation, examples of suitable tubulars include casing joints, liners, and the like.

Expansion swage 4 may include any expansion swage suitable for expanding a tubular. Without limitation, examples of suitable expansion swages include cones and the like. In an embodiment, expansion swage 4 is a conical device with the front direction defined towards the smaller diameter 20, and the rear direction defined towards the larger diameter portion 21 of expansion swage 4.

Figure 8:
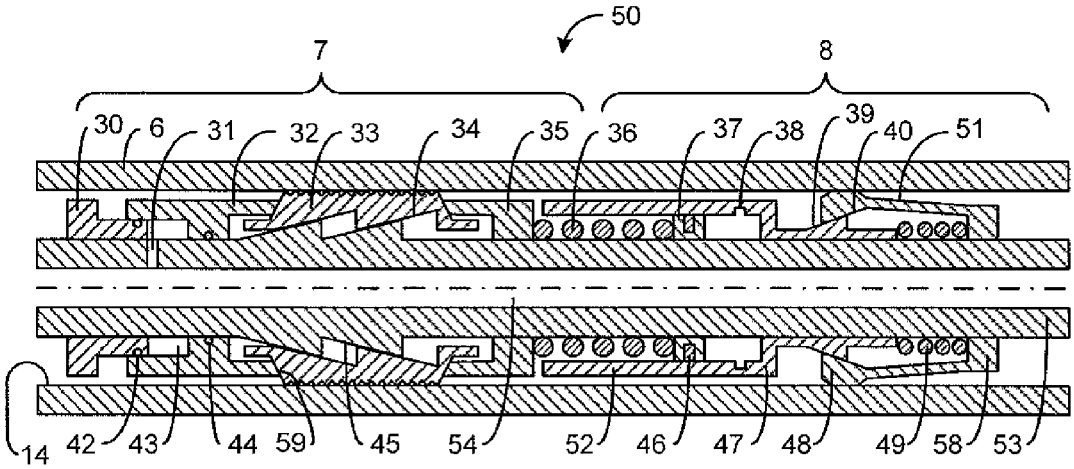
FIG. 8 illustrates a cross sectional side view of an embodiment of a section of the front anchor assembly while the sensor is inside the expandable tubular.
Figure 9:
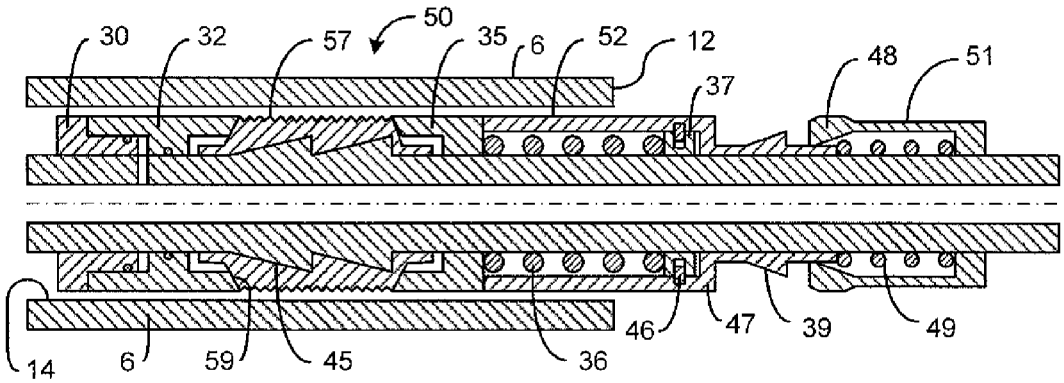
FIG. 9 illustrates a cross sectional side view of an embodiment of a section of the front anchor assembly after the sensor exits the tubular and permanently closes the front anchor.

As shown in FIG. 8, front anchor assembly 50 comprises front anchor 7 with sensor 8 positioned on body 53 inside the unexpanded portion of expandable tubular 6. Body 53 has fluid path 54 and passage 31, which communicates with cavity 43 to allow pressure to be exerted on piston 32 against travel stop 30. Seals 42 and 44 retain the pressure in cavity 43 and allow piston 32 to be driven in the forward direction. As shown in FIG. 9, embodiments of front anchor assembly 50 include piston 32 bearing on a plurality of gripping strips 33, each of which has a plurality of gripping surfaces 57 to bite into internal wall 14 of expandable tubular 6. Gripping strips 33 may include any suitable surface for gripping an internal wall. Without limitation, examples of suitable gripping strips 33 include hardened ridges, carbide inserts, and the like. Gripping strips 33 include a series of ramps 34 that ride on ramps 45 of body 53. As pressure is applied, piston 32 exerts force on griping strips 33 driving them up ramps 45 bringing front anchor 7 in an open position with gripping strips 33 providing an anchoring relationship with internal wall 14 of expandable tubular 6. When pressure is released, spring 36 exerts force against travel stop 37 on closing piston 35 driving gripping strips 33 down ramps 45 and 59 and bringing front anchor 7 in a closed position with the diameter less than internal diameter of expandable tubular 6, as shown in the embodiment of FIG. 9.

As shown in FIG. 8, embodiments of sensor 8 comprise sliding piston 47 having ramp 39 and elongated arm 52 with groove 38. Collet 51 is peinianently connected to body 53 on one end 58 and has multiple sensing elements 48 with ramps 40 at the other end. Spring 49 exerts force acting on sliding piston 47 having ramp 39. In embodiments, the heights of ramps 39 are selected such that sensing elements 48 remain on ramps 39 while sensor 8 is inside expandable tubular 6 being in contact with internal wall 14, as shown in the embodiment of FIG. 8. As shown in the embodiment of FIG. 9, upon exit of sensing elements 48 out of end portion 12 of expandable tubular 6, sensing elements 48 are not constrained by internal wall 14 of expandable tubular 6 and slide over ramps 39 allowing sliding piston 47 to move, under action of spring 49, towards the travel stop 37 until C-ring 46 is engaged in groove 38. C-ring 46 permanently controls the position of sliding piston 47 with regard to travel stop 37. In embodiments, the lengths of elongated wins 52 are selected to control the position of closing piston 35 corresponding to the closed position of front anchor 7.

An embodiment of the operation of the expansion assembly 10 is shown in FIGS. 1-7. As shown in FIG. 1, expansion assembly 10 may also include some other conventional components, not shown, such as a casing lock securing expansion tool to expandable tubular 6, a flow control valve, a filter, a guide shoe, and the like. The expansion process may take place in bottom-up or top-down modes. In bottom-up mode, expansion tool is connected to conduit 16 (i.e., a drill string, coiled tubing, or the like) at front end 9, and expansion swage 4 propagates up from the well towards the ground surface. While in the top-down mode, expansion tool is connected to conduit 16 at rear end 1, and expansion swage 4 propagates in the direction from the ground surface down into the wellbore.

Figure 5:
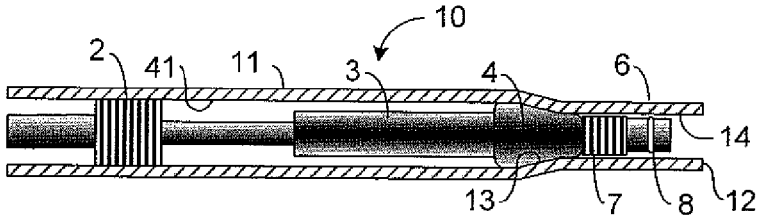
FIG. 5 illustrates a side view of an embodiment of the expansion assembly at the end of the idle stroke position.

For illustrative purposes, the following operational procedure is related to an embodiment when rear anchor 2 is dormant (i.e., being in a closed position with a diameter less than the internal diameter of expanded portion 11 of tubular 6) during the expansion process until sensor 8 exits the end portion 12. Without limitation, this configuration may eliminate fix-fix conditions (i.e., preventing longitudinal shrinkage of expandable tubular 6 during its expansion and the resulting extra thinning of the tubular wall). The construction of rear anchor 2 may be similar or the same as the construction of front anchor 7. As shown in the embodiment of FIG. 5, upon application of pressure, rear anchor 2 comes in an open position providing anchoring engagement with internal wall 41 of expanded portion 11 of expandable tubular 6 and comes in the closed position being disengaged from expandable tubular 6 upon release of pressure. However, until the exit of sensor 8 from end portion 12, the fluid passage (not shown) into rear anchor 2 is blocked, and rear anchor 2 remains in the closed position and dormant. It is only when a certain level of pressure (e.g., higher than the maximum expansion pressure, i.e. pressure necessary for expansion swage 4 propagation) is applied, the fluid passage is opened, and rear anchor 2 may be operated as described above. The fluid passage may be blocked by any suitable means. In an embodiment, the fluid passage is blocked by a rupture disk, a sleeve with a shear pin, or any combinations thereof.

Figure 3:
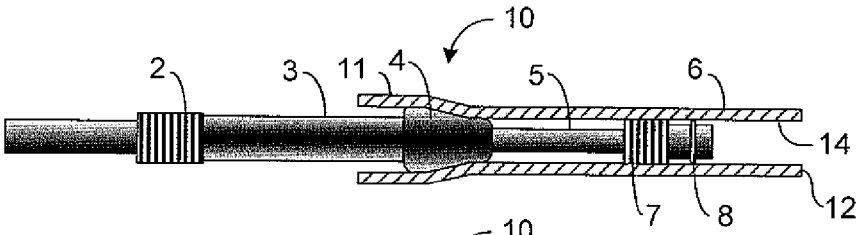
FIG. 3 illustrates a side view of an embodiment of the expansion assembly at the end of the reset stroke position.
Figure 4:
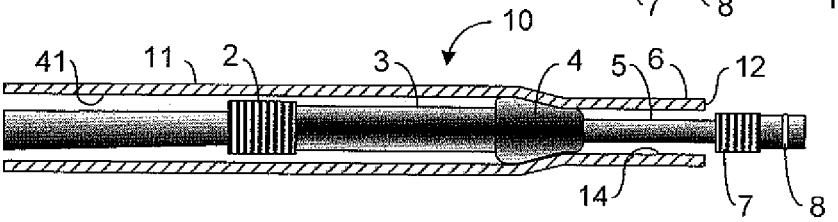
FIG. 4 illustrates a side view of an embodiment of the expansion assembly at the end of the reset stroke position when the sensor exits the end portion of the expandable tubular and brings the front anchor in a permanently closed position.
Figure 6:
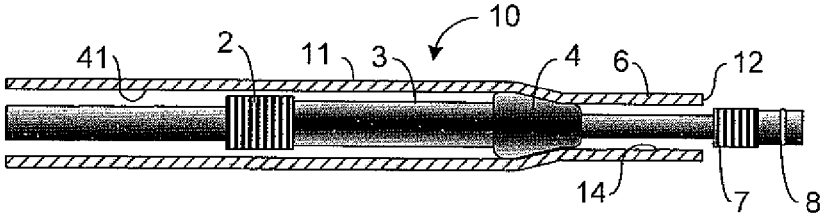
FIG. 6 illustrates a side view of an embodiment of the expansion assembly in the rest position after the rear anchor has been actuated.
Figure 7:
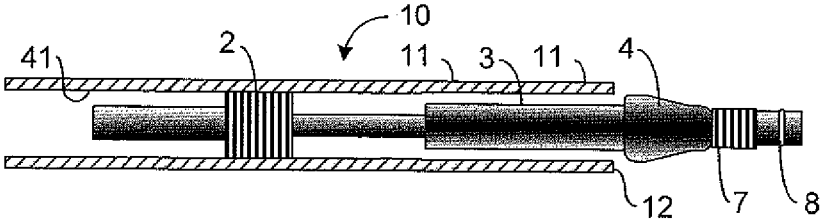
FIG. 7 illustrates a side view of an embodiment of the completion of the expansion process with the front anchor closed and rear anchor providing a reaction force suitable for expansion swage propagation.
Figure 10:
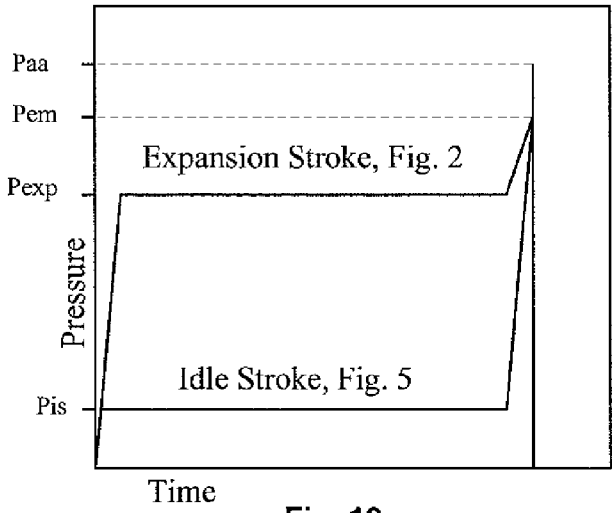
FIG. 10 illustrates an embodiment of a schematic pressure diagram for different stages of the expansion process.

After the expansion assembly 10 is deployed (i.e., run) to the desired location in the wellbore, embodiments include that pressure is communicated to expansion tool causing front anchor 7 to be engaged with internal wall 14 of expandable tubular 6. As shown in FIG. 10, at a certain pressure level, Pexp, referred to as an expansion pressure plateau, expansion swage 4 propagates inside expandable tubular 6 expanding it, which is called an expansion stroke and shown in FIG. 2. At the end of the expansion stroke, when the pistons (not illustrated) in thruster 3 come to the end point, the pressure starts rising to the maximum allowed expansion pressure, Pem, as shown n FIG. 10. Pem may be controlled by any suitable means. In an embodiment Pem is controlled at the pump (not illustrated) by a pop-off valve. In embodiments, Pem is set to a desired level. During the first expansion stroke, expanded portion 11 of expandable tubular 6 may be cladded to the wellbore casing or an open hole providing support for expandable tubular 6. Then the pressure may be released, and expansion tool may be reset, by moving front anchor 7 in the front direction, as shown in FIG. 3. This cycle of applying pressure and then releasing and resetting expansion tool is repeated multiple times until sensor 8 comes out of end portion 12 of expandable tubular 6, as shown in FIG. 4. At this point, sensor 8 brings front anchor 7 in a permanently closed position. When pressure is applied, expansion swage 4 does not propagate inside expandable tubular 6 since front anchor 7 is in the closed position and does not provide a reaction force sufficient for swage propagation. Instead, as shown in FIG. 5, front anchor 7 moves in the rear direction against the reaction force provided by expansion swage 4 against tubular expansion surface 13, which is called an idle stroke. As shown in FIG. 10, the pressure plateau level of the idle stroke, Pis, is significantly less than the expansion pressure, Pexp, at the expansion stroke. Without limitation, this signifies that front anchor 7 cannot be engaged with expandable tubular 6 and that rear anchor 2 may be actuated. In embodiments a shown in FIGS. 5 and 10, the maximum allowed expansion pressure is adjusted to the level sufficient to actuate rear anchor 2, Paa, which opens the fluid passage into rear anchor 2 and rear anchor 2 becomes active. As shown in FIG. 6, then the pressure is released, and expansion tool is reset. As shown in FIGS. 7 and 10, the pressure is applied again causing rear anchor 2 to be engaged with internal wall 14 of expanded portion 11 of expandable tubular 6 and at a certain level, Pexp, expansion swage 4 propagates through expandable tubular 6 completing the expansion process. At this point, the pressure is released, and expansion tool may be retrieved from the wellbore.

It is to be understood that expansion assembly 10 is not limited to exact details of construction, operation, or embodiments shown and described, as modifications and equivalents will be apparent to one of ordinary skill in the art. For example, expansion tool may have a number of different configurations. For instance, thruster 3 may be positioned in front of expansion swage 4. Expansion tool may also include a hydraulic valve for selective control of a flow operating fluid to thruster as disclosed in U.S. Pat. No. 7,640,976, which is incorporated by reference herein in its entirety to the extent that it does not contradict this application. Although in this embodiment, expansion tool is described as having a dormant rear anchor 2, expansion tool may comprise a longitudinally movable rear anchor 2, such as disclosed in U.S. Pat. No. 7,493,946, which is incorporated by reference herein in its entirety to the extent that it does not contradict this application. Alternatively (not illustrated), expansion tool may have no rear anchor 2, for example, in the case of bottom-up expansion when the final stage of expansion may be accomplished by pulling expansion swage 4 with the work string. Moreover, front anchor 7 may be of a different design, for example, a spring operated one way anchor. Also, sensor 8 may be of different kind such as mechanical spring operated or pressure operated, or electrically operated.

Although the present invention and its advantages have been described in detail, it should be understood that various changes, substitutions and alterations may be made herein without departing from the spirit and scope of the invention as defined by the appended claims.

What is claimed is:

1. An expansion assembly for disposition in a wellbore, comprising:

an expandable tubular comprising an internal wall and an end portion, wherein the internal wall comprises an internal diameter;

an expansion tool comprising:

an expansion swage defining a front direction towards a smaller diameter of the expansion swage;

a thruster;

a front anchor assembly positioned in front of the expansion swage, comprising:

a front anchor having an open position providing an anchoring relationship with the internal wall and a closed position providing the front anchor with a diameter less than an internal diameter of the expandable tubular; and a sensor positioned on an opposing side of the front anchor from the expansion swage providing that while the sensor is positioned inside the internal wall the front anchor is in the open position or in the closed position while upon exit of the sensor from the end portion the sensor brings the front anchor in the closed position.

2. The expansion assembly of claim 1, wherein upon exit of the sensor from the end portion the sensor brings the front anchor in the closed position permanently.

3. The expansion assembly of claim 1, further comprising a rear anchor.

4. The expansion assembly of claim 3, wherein the rear anchor is dormant until the sensor exits the end portion and is activated after the sensor exits the end portion.

5. The expansion assembly of claim 1, wherein the front anchor assembly comprises a body, wherein the sensor is positioned on the body.

6. The expansion assembly of claim 5, wherein the body comprises a fluid path, a passage, and a cavity, and wherein the passage allows pressure to communicate with the cavity.

7. The expansion assembly of claim 1, wherein the front anchor comprises a plurality of gripping strips.

8. An expansion tool for disposition in a wellbore, comprising:

an expansion swage defining a front direction towards a smaller diameter of the expansion swage;

a thruster;

a front anchor assembly positioned in front of the expansion swage, comprising:

a front anchor having an open position providing an anchoring relationship with an internal wall and a closed position providing the front anchor with a diameter less than an internal diameter of an expandable tubular; and a sensor positioned on an opposing side of the front anchor from the expansion swage providing that while the sensor is positioned inside the internal wall the front anchor is in the open position or in the closed position while upon exit of the sensor from an end portion the sensor brings the front anchor in the closed position.

9. The expansion tool of claim 8, wherein upon exit of the sensor from the end portion the sensor brings the front anchor in the closed position permanently.

10. The expansion tool of claim 8, further comprising a rear anchor.

11. The expansion tool of claim 10, wherein the rear anchor is dormant until the sensor exits the end portion and is activated after the sensor exits the end portion.

12. The expansion tool of claim 8, wherein the front anchor assembly comprises a body, wherein the sensor is positioned on the body.

13. The expansion tool of claim 12, wherein the body comprises a fluid path, a passage, and a cavity, and wherein the passage allows pressure to communicate with the cavity.

14. The expansion tool of claim 8, wherein the front anchor comprises a plurality of gripping strips.

15. A method of expanding a tubular in a wellbore, comprising:

(a) running an expansion assembly in the wellbore, wherein the expansion assembly comprises:

an expandable tubular comprising an internal wall and an end portion, wherein the internal wall comprises an internal diameter;

an expansion tool comprising:

an expansion swage defining a front direction towards a smaller diameter of the expansion swage;

a thruster;

a front anchor assembly positioned in front of the expansion swage, comprising:

a front anchor having an open position providing an anchoring relationship with the internal wall and a closed position providing the front anchor with a diameter less than an internal diameter of the expandable tubular; and a sensor positioned on an opposing side of the front anchor from the expansion swage providing that while the sensor is positioned inside the internal wall the front anchor is in the open position or in the closed position while upon exit of the sensor from the end portion the sensor brings the front anchor in a permanently closed position; and a rear anchor;

(b) setting a maximum allowed expansion pressure level;

(c) applying pressure for expansion swage propagation and observing an expansion pressure plateau level;

(d) releasing pressure and resetting the expansion tool;

(e) repeating steps (b) and (c) until observing when a pressure plateau level is lower than the expansion pressure plateau level;

(f) resetting the maximum expansion pressure level to a level to activate the rear anchor and applying pressure activating the rear anchor;

(g) releasing pressure and resetting the expansion tool;

(h) applying pressure and expanding the end portion; and (i) releasing pressure and retrieving the expansion tool out of the well.

16. The method of claim 15, wherein the rear anchor is dormant until the sensor exits the end portion and is activated after the sensor exits the end portion.

17. The method of claim 15, wherein the front anchor assembly comprises a body, wherein the sensor is positioned on the body.

18. The method of claim 17, wherein the body comprises a fluid path, a passage, and a cavity, and wherein the passage allows pressure to communicate with the cavity.

19. The method of claim 18, wherein the front anchor comprises a plurality of gripping strips.

20. The method of claim 19, wherein the gripping strips comprise ramps.

* * * * *